US009258632B2

(12) United States Patent
Jiang

(10) Patent No.: US 9,258,632 B2
(45) Date of Patent: Feb. 9, 2016

(54) SPEAKER BOX

(71) Applicant: Wentao Jiang, Shenzhen (CN)

(72) Inventor: Wentao Jiang, Shenzhen (CN)

(73) Assignee: AAC Acoustic Technologies(Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/615,523

(22) Filed: Feb. 6, 2015

(65) Prior Publication Data

US 2015/0156573 A1 Jun. 4, 2015

Related U.S. Application Data

(63) Continuation-in-part of application No. 13/324,703, filed on Dec. 13, 2011, now abandoned.

(51) Int. Cl.
*H04R 1/02* (2006.01)

(52) U.S. Cl.
CPC ..... *H04R 1/025* (2013.01); *H04R 1/021* (2013.01)

(58) Field of Classification Search
CPC ..... H04R 1/021; H04R 1/025; H04R 1/023; H04R 1/02; H04R 5/02; H04R 2499/11; H04R 1/026
USPC ..... 381/395, 332
See application file for complete search history.

(56) References Cited

U.S. PATENT DOCUMENTS

2007/0081691 A1* 4/2007 Park et al. ..... H04M 1/03 381/386

* cited by examiner

*Primary Examiner* — Paul S Kim
(74) *Attorney, Agent, or Firm* — IPro, Inc.; Na Xu

(57) ABSTRACT

A speaker box includes an upper case defining at least a first hole, a lower case connected with the upper case for forming an inner cavity and defining at least a second hole, at least an electroacoustic transducer received in the inner cavity, and at least a screw passing through the first hole and the second hole for fixing the speaker box to an external electronic device.

10 Claims, 2 Drawing Sheets

SPEAKER BOX

CROSS REFERENCE TO RELATED APPLICATION

This application is a continuation-in-part application of U.S. Ser. No. 13/324,703 filed on Dec. 13, 2011.

FIELD OF THE INVENTION

The present disclosure generally relates to the art of speaker boxes, and especially to a speaker box having an upper case assembled with a lower case.

RELATED ART OF THE INVENTION

Speaker boxes are widely used in many types of portable electronic devices, such as mobile phones, notebook computers, and hearing aids, for converting audio electrical signals to audible sounds.

A speaker box, related to the present invention, generally includes an upper case, a lower case connected with the upper case for forming a receiving cavity, an electroacoustic transducer received in the receiving cavity. To fix the speaker box to an external electronic device, such as a mobile phone, a notebook computer and a hearing aid, generally, the lower case defines at least a hole. And at least a screw is provided for passing through the hole and screwed into with the external electronic device. So that, the lower case and the external electronic device are assembled with each other, and as a result, the speaker box is fixed to the external electronic device.

But, when the speaker box is forced to vibrate seriously in a condition of external force, because only the lower case is screwed to the external electronic device by the screw, the upper case will drop off from the lower case easily. So, the structure of the speaker box is not unstable, and leads to air leakage easily.

Therefore, an improved speaker box that can resolve the problems mentioned-above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the embodiment.

DETAILED DESCRIPTION OF THE EXEMPLARY EMBODIMENT

Reference will now be made to describe one exemplary embodiment of the present invention in detail.

Figure 1:
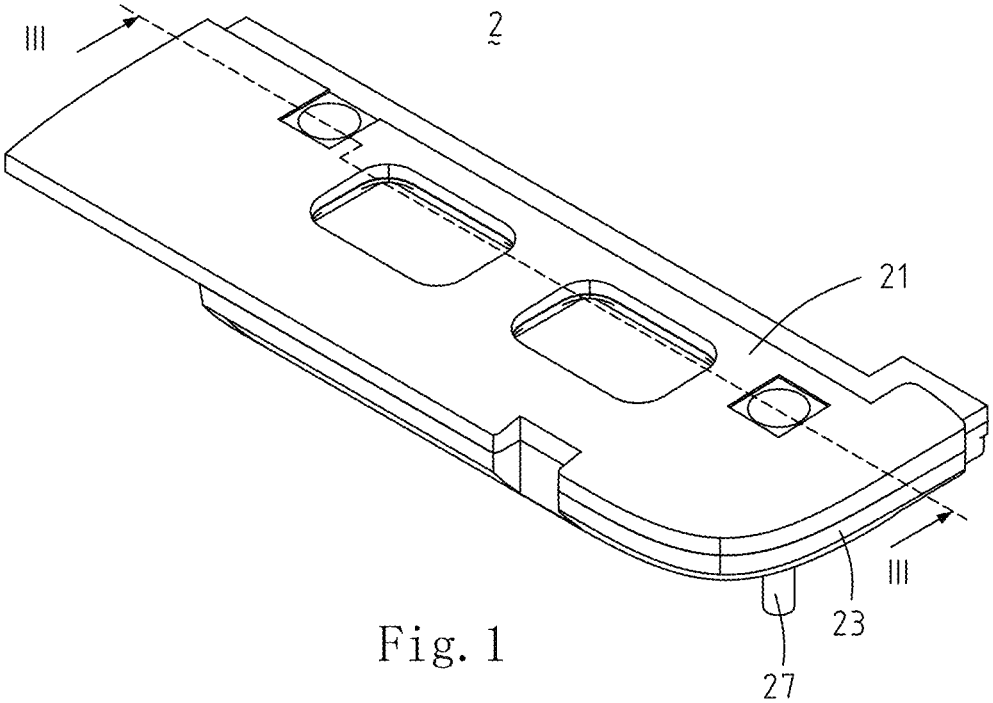
FIG. 1 depicts an isometric assembled view of a speaker box in accordance with one exemplary embodiment of the present invention.
Figure 2:
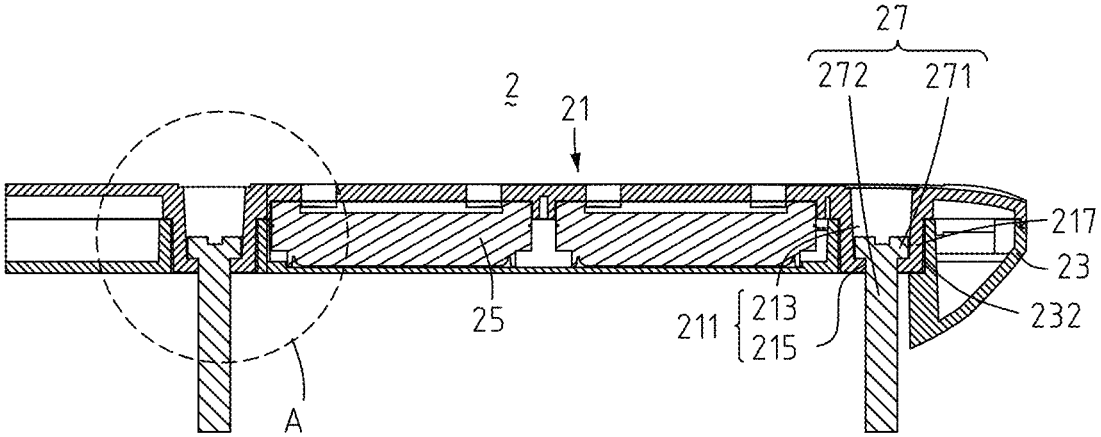
FIG. 2 depicts a cross-sectional view of the speaker box taken along line III-III in FIG. 1.
Figure 3:
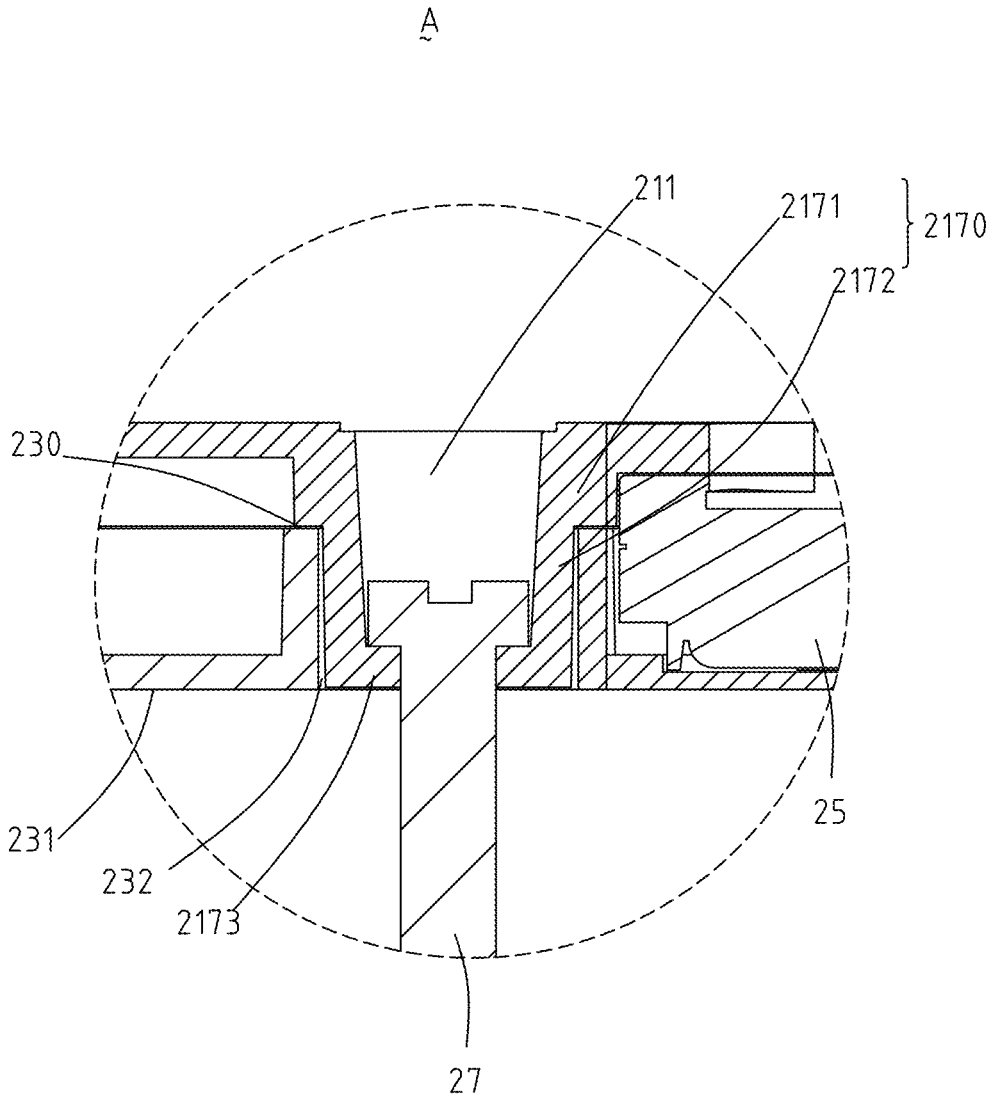
FIG. 3 is an enlarged view of circled part A of FIG. 2.

Referring to FIGS. 1-3, a speaker box 2, in accordance with an exemplary embodiment of the present invention, includes an upper case 21, a lower case 23, two electroacoustic transducers 25 and a double of screws 27.

The upper case 21 is connected with the lower case 23 for forming an inner cavity where the electroacoustic transducers 25 are positioned.

The lower case 23 includes an upper surface 230 connected with the upper case 21 and a lower surface 231 opposite to the upper surface 230.

The electroacoustic transducer 25 is used for converting audio electrical signals to audible sounds. The structure of the electroacoustic transducer 25 is public-known art, and will not be described in detail.

Each of the screws 27 includes a hat portion 271 and a pole portion 272. A diameter of the hat portion 271 is greater than a diameter of the pole portion 272.

The upper case 21 includes a pair of projecting elements 217 towards the lower case 23. Each of the projecting elements 217 includes an annular sidewall 2170, an annular bottom 2173 close to the lower case 23 and a first hole 211 passing through the annular sidewall 2170 and the annular bottom 2173. The first hole 211 includes a first section 213 surrounded by the annular sidewall 2170 and a second section 215 surrounded by the annular bottom 2173. Further, A diameter of the first section 213 of the hole 211 is not smaller than the diameter of the hat portion 271 of the screw 27. A diameter of the second section 215 of the hole 211 is not smaller than the diameter of the pole portion 272 of the screw 27 and smaller than the diameter of the hat portion 271 of the screw 27. In the embodiment, the diameter of the first section 213 of the hole 211 is approximately equal to the diameter of the hat portion 271 of the screw 27. A diameter of the second section 215 of the hole 211 is approximately equal to the diameter of the pole portion 272 of the screw 27. The annular sidewall 2170 includes a first part 2171 and a second part 2172. The diameter of the first part 2171 is greater than that of the second part 2172.

The lower case 23 includes a pair of second holes 232 corresponding to each projecting element 217 and penetrating the lower case 23 from the upper surface 230 to the lower surface 231. In other words, each of projecting elements 217 extends into a corresponding second hole 231, i.e. each projecting element 217 is received in the corresponding second hole 232. Specifically, the second part 2172 is received in the corresponding second hole 232, and the first part 2171 is engaged with the upper surface 230 of the lower case 23. Each of the annular bottoms 2173 is exposed from the second hole 231 and coplanar with the lower surface 231 of lower case 23. Further, an inner surface of the second hole 231 contacts with the second part 2172 of the annular sidewall 2170 of the projecting element 217.

When the speaker box 2 is mounted to the external electronic device, the lower surface 231 of the lower case 23 and the bottom 2171 of the projecting element 217 are positioned on a surface of the external electronic devices, and, then the screw 27 passes through the first hole, and finally, the pole portion 272 of the screw 27 is screwed into the external electronic devices. So, the speaker box 2 is fixed to the external electronic devices firmly by the screw 27.

As the upper case 21 and the lower case 23 are screwed to the external electronic device together, when the speaker box 2 is forced to vibrate seriously in a condition of external force, the upper case 21 can not drop off from the lower case 23. Therefore, the speaker box 2 can be mounted to the external electronic device firmly.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A speaker box, comprising:

an upper case;

a lower case including an upper surface connected with the upper case for forming an inner cavity and a lower surface opposite to the upper surface;

at least an electroacoustic transducer received in the inner cavity;

at least a screw; and wherein, the upper case includes at least one projecting element protruding towards the lower case, each projecting element including an annular sidewall, an annular bottom close to the lower case and a first hole passing through the annular sidewall and the annular bottom;

the lower case further includes at least one second hole corresponding to each projecting element and penetrating the lower case from the upper surface to the lower surface;

each projecting element is received in corresponding second hole;

the annular sidewall of the projecting element contacts with an inner surface of the second hole, and the annular bottom of the projecting element is exposed from the second hole;

the screw passes through the first hole and the second hole for fixing the speaker box to an external electronic device.

2. The speaker box as described in claim 1, wherein each screw includes a hat portion and a pole portion, a diameter of the hat portion bigger than a diameter of the pole portion; and the screw fixing the speaker box to the external electronic device by the pole portion being screwed into the external electronic device.

3. The speaker box as described in claim 2, wherein the first hole comprises a first section surrounded by the annular sidewall and a second section surrounded by the annular bottom, a diameter of the first section of the first hole is approximately equal to the diameter of the hat portion of the screw, and a diameter of the second section of the first hole is approximately equal to the diameter of the pole portion of the screw.

4. The speaker box as described in claim 1, wherein the annular bottom of the projecting element is coplanar with the lower surface of the lower case.

5. The speaker box as described in claim 1, wherein each annular sidewall includes a first part engaged with the upper surface of the lower case and a second part received in the second hole and contacting with the inner surface of the second hole, a diameter of the first part greater than that of the second part.

6. A speaker box, comprising:

an upper case;

a lower case assembled with the upper case;

at least a screw; and wherein, the upper case includes at least one projecting element protruding towards the lower case, each projecting element including an annular sidewall, an annular bottom close to the lower case and a first hole passing through the annular sidewall and the annular bottom;

the lower case includes an upper surface, a lower surface opposite to the upper surface and at least one second hole corresponding to each projecting element and penetrating the lower case from the upper surface to the lower surface;

each projecting element is received in corresponding second hole;

the annular sidewall of the projecting element contacts with an inner surface of the second hole, and the annular bottom of the projecting element is exposed from the second hole;

the screw passes through the first hole and the second hole for fixing the speaker box to an external electronic device.

7. The speaker box as described in claim 6, wherein each screw includes a hat portion and a pole portion, a diameter of the hat portion bigger than a diameter of the pole portion; and the screw fixing the speaker box to the external electronic device by the pole portion being screwed into the external electronic device.

8. The speaker box as described in claim 7, wherein the first hole comprises a first section surrounded by the annular sidewall and a second section surrounded by the annular bottom, a diameter of the first section of the first hole is approximately equal to the diameter of the hat portion of the screw, and a diameter of the second section of the first hole is approximately equal to the diameter of the pole portion of the screw.

9. The speaker box as described in claim 6, wherein the annular bottom of the projecting element is coplanar with the lower surface of the lower case.

10. The speaker box as described in claim 6, wherein each annular sidewall includes a first part engaged with the upper surface of the lower case and a second part received in the second hole and contacting with the inner surface of the second hole, a diameter of the first part greater than that of the second part.

* * * * *